United States Patent [19]

Levick

[11] Patent Number: 4,760,950

[45] Date of Patent: Aug. 2, 1988

[54] PITA BREAD SANDWICH HOLDER

[76] Inventor: Lois B. Levick, 32 Savoy Rd., Framingham, Mass. 01701

[21] Appl. No.: 887,513

[22] Filed: Jul. 21, 1986

[51] Int. Cl.[4] ..... B65D 5/42

[52] U.S. Cl. ..... 229/103; 206/216; 248/174; 383/2

[58] Field of Search ..... 229/103, DIG. 13; 206/216, 541, 45.14, 45.19, 45.24, 45.25; 383/2, 4, 14, 104; 248/152, 174, 459

[56] References Cited

U.S. PATENT DOCUMENTS

| | | | |
|---|---|---|---|
| 1,252,073 | 1/1918 | Achert | 248/174 |
| 1,810,347 | 6/1931 | Daitch | 383/2 |
| 2,071,394 | 2/1937 | Douglas | 248/174 |
| 4,509,674 | 4/1985 | Levick | 229/DIG. 13 |

FOREIGN PATENT DOCUMENTS

| | | | |
|---|---|---|---|
| 547391 | 8/1942 | United Kingdom | 383/2 |

*Primary Examiner*—Stephen Marcus

*Assistant Examiner*—Gary E. Elkins

*Attorney, Agent, or Firm*—Irving M. Kriegsman

[57] ABSTRACT

A holder for a pita bread sandwich or other similar article of food is disclosed. The holder is constructed from a cardboard blank which is cut and scored to define a pair of bottom panels, a pair of side panels hingedly connected to the bottom panels, a pair of outer panels hingedly connected on either side of the side panels, each outer panel having a finger receiving slot thereon, a pair of locking tabs hingedly connected to one of the outer panels, and a pair of locking slits on the outer panel. When assembled in one orientation, the two bottom panels extend down and the two side panels define a pocket open at the top for receiving and holding a pita bread sandwich, the two outer panels serving as supports for standing the holder upright on a table top or other surface. However, by pivoting the two outer panels upward, the outer panels become a combination handle and cover for use in transporting a pita bread sandwich which may be contained in the pocket from one location to another.

5 Claims, 2 Drawing Sheets

PITA BREAD SANDWICH HOLDER

BACKGROUND OF THE INVENTION

The present invention relates generally to holders and more particularly to a holder for supporting a pita bread sandwich or other similar food item.

Pita bread sandwiches have become a very popular type of bread sandwich over the past few years. One reason for their popularity has been the nutritional value of the particular ingredients used in the pita bread. Another reason for their popularity has been the disk-shaped hollow configuration of the pita bread itself which when cut off at the top or near the middle can be opened to form a curved pocket which may be easily filled or stuffed with salads, vegetables, cold cuts and the like. One of the problems with pita bread sandwiches, however, is that they are not self standing. Consequently, pita bread sandwiches must either be cradled at all times in the hands of a person, balanced, if possible, upright against another object, or supported in some type of holder in order to prevent spillage of the contents from the pocket. Another problem with pita bread sandwiches is that they must be carefully held upright when being moved from one location to another to avoid spillage.

In my U.S. Pat. No. 4,509,674 which issued on Apr. 9, 1985 there is disclosed a holder for use in supporting a pita bread sandwich in an upright position on a table top which is constructed from two identical cardboard blanks, each of which is cut and scored to define a trapezoidally shaped lower panel, a pair of glue flaps hingedly connected on either side of the side section panels, a semicircular shaped upper panel hingedly connected to the top of the lower panel and a plurality of glue tabs hingedly connected to the upper panel along its outer edge. In assembling the holder the side section panels and upper panel on each blank are folded forwardly in front of the lower panel and the glue flaps and glue tabs folded back. The glue flaps and glue tabs on one blank are then secured to the glue flaps and glue tabs respectively on the outer blank. Once assembled, the two upper panels define a semi-circular shaped pocket open at the top for receiving and holding the pita bread sandwich, the two lower panels serving as supports for standing the holder upright on the table top and the side sections defining tapered pleats connecting the two lower panels at their side edges. In another disclosed embodiment, the holder is a unitary molded plastic structure. Two versions are described, one for holding a single pita bread and the other for holding a plurality of pita bread sandwiches.

In U.S. Pat. No. 2,071,394 which issued to G. F. Douglas on Feb. 23, 1937 there is disclosed a combination ash tray and advertising device formed of a blank having two center sections and two outer sections defined by fold creases, the two center sections folding upwardly toward each other and forming a V-shape receptacle, the two outer sections folding downwardly and forming supports to maintain the receptacle upright upon its apex, and joining end portions at the unattached edges of the center sections enclosing the ends of the receptacle.

In U.S. Pat. No. 1,252,073 which issued to W. K. Achert on Jan. 1, 1918 there is disclosed a display support comprising oppositely disposed sides, oppositely disposed end flaps attached to opposite edges of the sides, and adapted to be pivotally connected to form ends extending from side to side, a bottom having a series of portions adapted to be folded with relation to one another, and inner walls extending between the bottom and tops of the sides, whereby the sides will move into gripping engagement with an object located in the support and whereby the inner walls will be moved into engagement with the sides of the object when the object contacts the bottom.

Accordingly, it is an object of this invention to provide a new and improved holder.

It is another object of this invention to provide a holder for a pita bread sandwich or other similarly shaped food item.

It is a further object of this invention to provide a holder which is self supporting and which is capable of supporting a pita bread sandwich in an upright position.

It is still a further object of this invention to provide a holder for supporting a pita bread sandwich in an upright position on a table top or other similar surface which can be easily converted into a container having a cover for use in transporting the pita bread sandwich from one location to another.

It is still a further object of this invention to provide a holder for holding a pita bread sandwich which can be fabricated from a single blank of suitable material, which is easy and inexpensive to manufacture, which can be mass produced, and which is easy to use.

It is yet still another object of this invention to provide a holder for a pita bread sandwich is disposable.

It is another object of this invention to provide a blank construction that can be assembled to provide either a self supporting holder for a pita bread sandwich or a container having a cover for a pita bread sandwich.

It is a further object of this invention to provide a blank construction which can be assembled to form a container for a pita bread sandwich having a combination handle and cover.

SUMMARY OF THE INVENTION

A holder for a pita bread sandwich constructed according to the teachings of the present invention comprises a blank of foldable material cut and scored to define a pair of side panels hingedly interconnected and a pair of outer panels hingedly connected to said side panels, one on each side thereof, said side panels forming the side walls of a pocket for holding the pita bread sandwich when the blank is assembled and said outer panels serving in one orientation as supports for the pocket and in another orientation as a cover for the pocket.

Various features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which like reference numerals or characters represent like parts and wherein.

DETAILED DESCRIPTION OF PREFERRED EMBODIMENTS

The present invention is directed to a holder for use in supporting a pita bread sandwich in an upright position on a table top or other similar surface but which can be easily converted into a container having a cover for use in transporting the pita bread sandwich from one location to another. Two embodiments of the invention will hereinafter be described, one which includes locking tabs and the other which does not contain locking tabs.

Although the invention will be described in connection with holding a pita bread sandwich it is to be understood that the holder is also applicable for use, if desired, in holding taco shells or other pouch type sandwiches or other types of food products and items.

Figure 1:
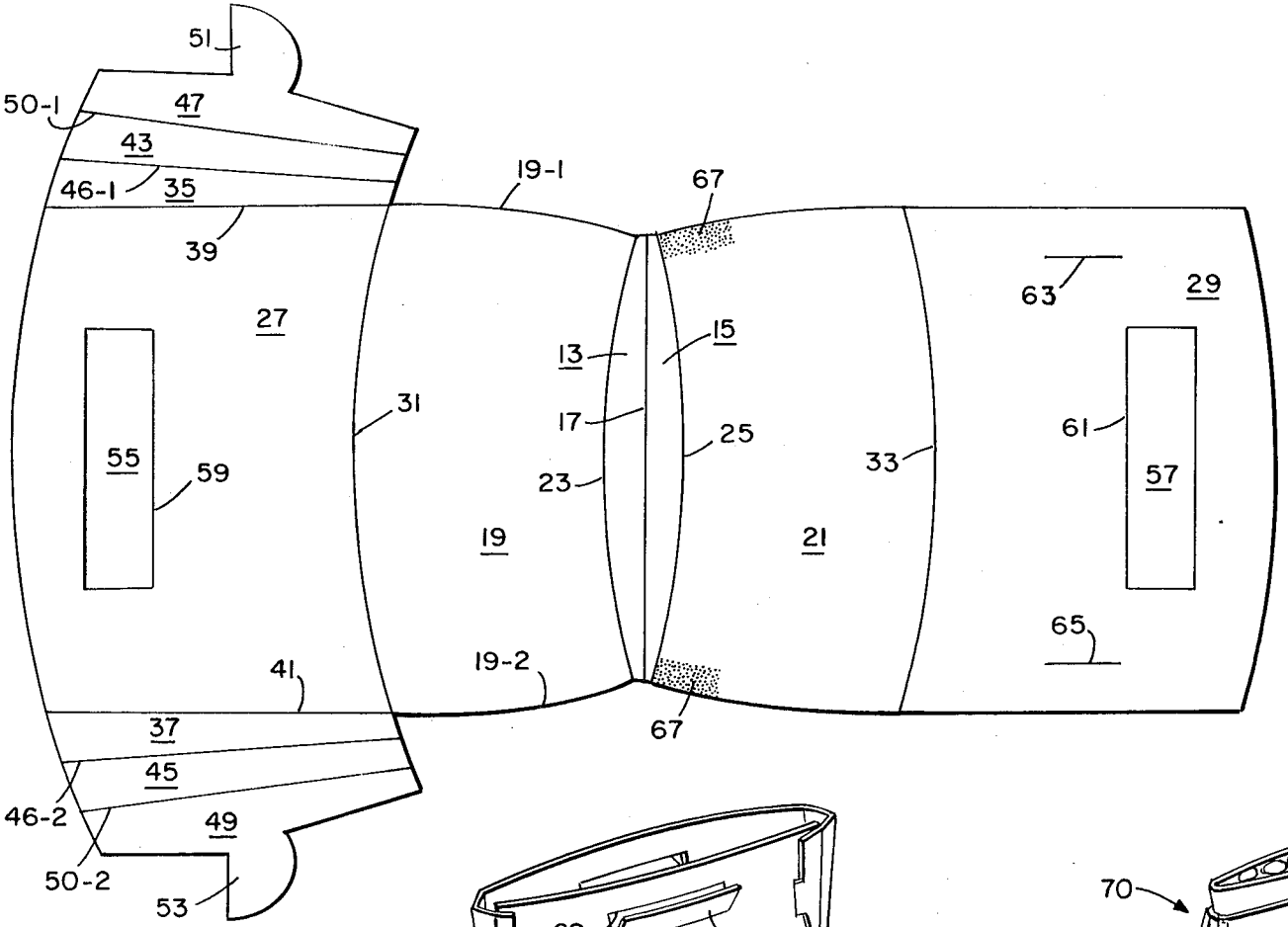
FIG. 1 is a plan view taken from the top of a blank from which a pita bread sandwich holder may be constructed according to one embodiment of the present.

Referring now to the drawings, and in particular to FIG. 1 there is illustrated a blank from which the holder is made according to one embodiment of the invention, the blank being identified by reference numeral 11.

Blank 11 is a unitary blank made of cardboard, paperboard, or other foldable sheet material, including plastics, which is of suitable thickness and which is cut and scored as will hereinafter be described.

As can be seen, blank 11 includes a pair of four sided bottom panels 13 and 15 having the same size and shape which are hingedly interconnected by a fold line 17 which is straight. A pair of four sided side panels 19 and 21 having the same size and shape are hingedly connected to bottom panels 13 and 15, one on each side thereof, by fold lines 23 and 25 which are slightly curved and which define the outer edges of bottom panels 13 and 15, respectively. A pair of four sided outer panels 27 and 29 are hingedly connected to side panels 19 and 21, one on each side thereof, by fold lines 31 and 33 which are slightly curved and which define the outer edges of side panels 19 and 21.

A pair of four sided first end sections 35 and 37 are hingedly connected to outer panel 27 one on the top and one on the bottom thereof by fold lines 39 and 41 which are straight and which define the top and bottom edges, respectively, of outer panel 27. A pair of four sided second end sections 43 and 45 are hingedly connected to first end sections 35 and 37 by a pair of fold lines 46-1 and 46-2, and a pair of four sided third end sections 47 and 49 are hingedly connected to second end sections 43 and 45 by a pair of fold lines 50-1 and 50-2. Third end sections 47 and 49 include outwardly projecting locking tabs 51 and 53.

Outer panels 27 and 29 may each include a tab 55 and 57, respectively. Tabs 55 and 57 are both of rectangular construction and are hingedly connected to their respective panels by fold lines 59 and 61, respectively. Outer panel 29 includes a pair of straight locking tab engaging slits 63 and 65, which are suitably sized and positioned to receive locking tabs 51 and 53 when the holder is fully assembled as will hereinafter be described. An adhesive 67, either pressure sensitive or moisture activated, is applied to side panel 19 at two locations a small distance from the outer edges 19-1 and 19-2 to seal off the bottom corners and at least a portion of the sides of the pocket formed by side panels 19 and 21 when the blank is assembled.

Figure 2:
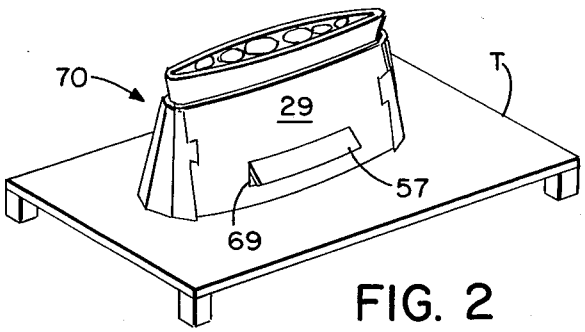
FIG. 2 is an isometric view of the holder made from the blank of FIG. 1, fully assembled, resting on a table top and supporting a pita bread sandwich.

To form the holder shown in FIG. 2 from blank 11, bottom panels 13 and 15 are first pivoted upwards about straight fold line 17 until the termini of curved fold lines 31 and 33 are in proximity to each other. Once pivoted, side panels 19 and 21 and bottom panels 13 and 15 together form a pocket for a pita bread sandwich with bottom panels 13 and 15 serving as slanting base forming bottom walls of the pocket, side panels 19 and 21 serving as side walls of the pocket and glue spots 67 and 69 sealing off the pocket near the bottom corners. Outer panels 27 and 29 are then pivoted downward about curved fold lines 31 and 33, respectively, until they are oriented in a roughly parallel fashion. Lastly, first end sections 35 and 37 are pivoted about fold lines 39 and 41, respectively, until locking tabs 51 and 53 fit into locking tab engaging slits 63 and 65, respectively. The side panels 19 and 21 and outer panels 27 and 29 are sized relative to each other so that when assembled, the holder rests on outer edges 27-1 and 29-1 of outer panels 27 and 29, respectively, and not on bottom edge 17.

Figure 3:
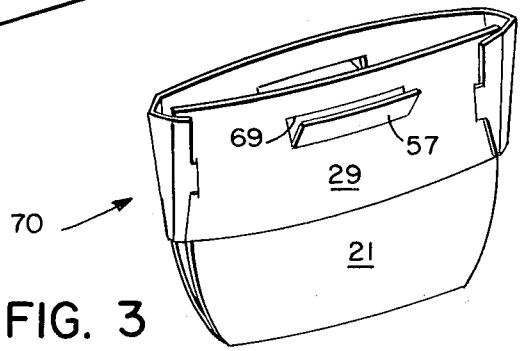
FIG. 3 is an isometric view showing how the holder made from the blank shown in FIG. 1 may be assembled in an arrangement different than that of FIG. 2 for use as a container with a cover for a pita bread sandwich.

To transform the fully assembled pita bread sandwich holder shown in FIG. 2 and identified by reference numeral 70 into a container for the pita bread having a cover as shown in FIG. 3, locking tabs 51 and 53 are first removed from locking tab engaging slits 63 and 65, respectively. Next, side panels 19 and 21 are kept stationary while outer panels 27 and 29 are pivoted 180 degrees about curved fold lines 31 and 33, respectively. Lastly, end sections 35 and 37 are pivoted about fold lines 39 and 41 until locking tabs 51 and 53 fit into locking tab engaging slits 63 and 65, respectively. Tabs 55 and 57 can be pivoted about fold lines 59 and 61 to create finger receiving openings or slots 69-1 and 69-2 by which the combination carrying container and cover can be easily grasped.

Instead of using locking tabs and slits to secure the outer panels together at their side panels, other means, such as an adhesive, may be employed. Also, instead of having both locking tabs 51 and 53 connected by sections to one outer panel and both slits 63 and 65 on the other outer panel, one tab and one slit could be on each outer panel.

Figure 4:
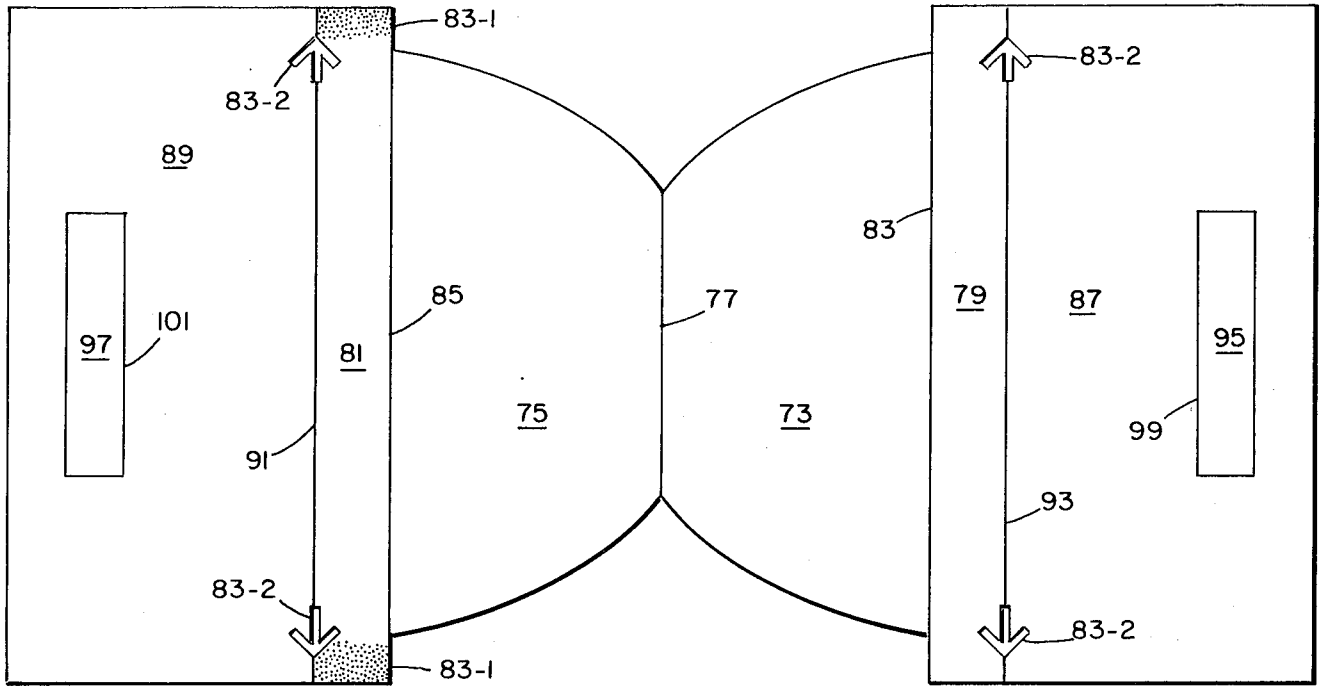
FIG. 4 is a plan view taken from the bottom of a blank from which a pita bread sandwich holder may be constructed according to another embodiment of the present invention.

Referring now to FIG. 4, there is illustrated another blank from which the holder is made according to another embodiment of the invention, the blank being identified by reference numeral 71.

Blank 71 is a unitary blank made of cardboard, paperboard, or other foldable sheet material, including plastics, which is of suitable thickness and which is cut and scored as will hereinafter be described.

As can be seen, blank 71 includes a pair of truncated semicircular shaped side panels 73 and 75 of the same size and shape which are hingedly interconnected by a straight fold line 77. A pair of rectangular upper support panels 79 and 81 of the same size and shape are hingedly connected to side panels 73 and 75, one on each side thereof, by fold lines 83 and 85, respectively, which not only define the outer edge of side panels 73 and 75 but also extend a short distance in both directions beyond the outer edge of side panels 73 and 75. A pair of rectangular lower support panels 87 and 89 of the same size and shape are hingedly connected to upper support panels 79 and 81, respectively, one on each side thereof, by fold lines 91 and 93 which define the outer edges of upper support panels 79 and 81, respectively. Lower support panels 87 and 89 may each include a tab 95 and 97, respectively. Tabs 95 and 97 are both of rectangular construction and are hingedly connected to their respective panels by fold lines 99 and 101, respectively.

Figure 5:
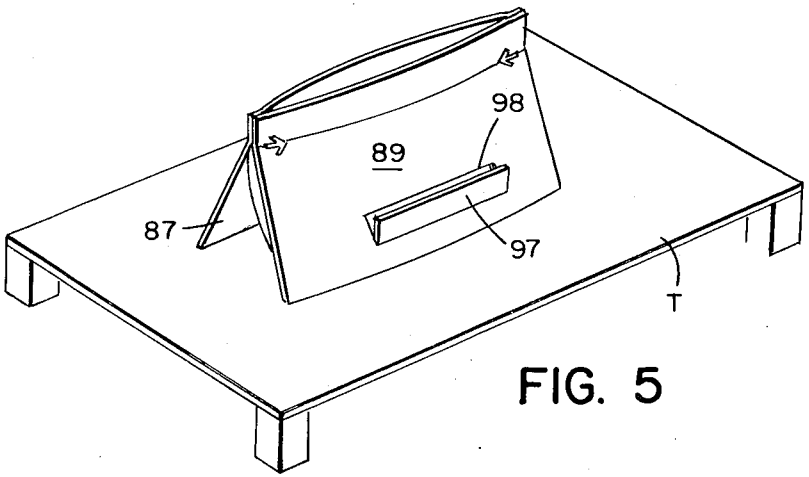
FIG. 5 is an isometric view of the holder made from the blank of FIG. 4, fully assembled, resting on a table top and supporting a pita bread sandwich.

To form the holder illustrated in FIG. 5 from blank 71, side panels 73 and 75 are pivoted upwards about straight fold line 77 until the termini of fold lines 83 and 85 are in proximity to each other. Next, lower support panels 87 and 89 are simultaneously pulled away from each other and pivoted downwards about fold lines 91 and 93, respectively, until blank 71 is in a self-supporting orientation. A first pair of adhesive spots 83-1 are placed near the outer edges of inner panel 81 for support purposes when the blank is assembled and pairs of arrow-shaped closure slits 83-2 are formed near the top outer edges of outer panels 87 and 89.

Figure 6:
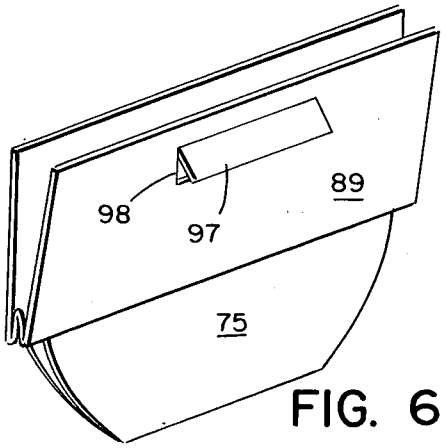
FIG. 6 is an isometric view showing how the holder made from the blank shown in FIG. 4 may be assembled in an arrangement different than that of FIG. for use as a container with a cover for a pita bread sandwich.

To transform the fully assembled pita bread sandwich holder shown in FIG. 5 and identified by reference numeral 94 into a carrying container having a cover as shown in FIG. 6, main support panels 87 and 89 are pivoted upwards 180 degrees about fold lines 91 and 93, respectively, while side panels 73 and 75 are kept stationary. Next, the outer edges of main support panels 87 and 89 are brought into contact with each other. Lastly, tabs 95 and 97 can be pivoted about fold lines 99 and 101, respectively, to create finger inserting slots 98 through which the combination carrying container and cover 94 can easily be grasped.

The embodiments of the present invention are intended to be merely exemplary and those skilled in the art shall be able to make numerous variations and modifications without departing from the spirit of the present invention. All such variations and modifications are intended to be within the scope of the present invention as defined in the appended claims.

What is claimed is:

1. A holder for supporting a pouch type sandwich in an upright position, said holder comprising:

a. a sheet of foldable material having a front side, a back side and cut and scored to define:

i. a pair of bottom panels hingedly interconnected, ii. a pair of four sided side panels hingedly interconnected to said bottom panels, one on a side of each bottom panel, iii. a pair of outer panels hingedly connected to said side panels, one on a side of each side panel opposite the connections of said side panels with said bottom panels, one of said outer panels having a pair of locking slits, iv. a pair of locking tabs hingedly connected to one of said outer panels, v. said bottom panels forming a bottom of a pocket and said side panels forming the sides of said pocket when the sheet of foldable material is erected into a holder, vi. said outer panels serving in a first orientation as supports for said holder and in a second orientation as a cover for said holder, vii. said locking tabs being positioned to engage said locking slits and lock said two outer panels together when said holder is in said first orientation and in said second orientation, and b. adhesive means on a front side of each side panel for securing a portion of said two side panels together at their front sides in facing relationship.

2. The holder of claim 1 and further including a pair of finger receiving slots, one on each of said outer panels, to facilitate holding said holder when said holder is in said second orientation and wherein said outer panels are hingedly connected to their respective side panels by curved fold lines so as to provide a pocket having a curved opening at the top.

3. A holder for holding a pita bread sandwich in an upright position comprising:

a. a sheet of foldable material cut and scored to define:

i. a pair of truncated semicircular shaped side panels hingedly interconnected, ii. a pair of upper support panels hingedly connected to the side panels, one on a side of each of said side panels, and iii. a pair of lower support panels hingedly connected to the upper support panels, one on a side of each side panel opposite the connections of said upper support panels with said side panels.

iv. said side panels forming the sidewalls of a pocket when said holder is erected, and said lower support panels serving in a first orientation as supports for said holder and in a second orientation as a cover for said holder, and b. adhesive means on outer edges of said upper support panels securing said upper support panels to one another for support purposes.

4. The holder of claim 3 and further including closure slits for selectively maintaining said holder in either one of said two orientations.

5. The holder of claim 4 and further including finger receiving slots in each lower support panel to facilitate holding said holder by said lower support panels.

* * * * *